United States Patent [19]

Nishimoto

[11] Patent Number: 4,712,899

[45] Date of Patent: Dec. 15, 1987

[54] PHOTOSENSITIVE MATERIAL TREATING APPARATUS

[75] Inventor: Kanichi Nishimoto, Wakayama, Japan

[73] Assignee: Noritsu Kenkyu Center Co., Ltd., Wakayama, Japan

[21] Appl. No.: 10,421

[22] Filed: Feb. 3, 1987

[30] Foreign Application Priority Data

| | | | |
|---|---|---|---|
| Feb. 10, 1986 | [JP] | Japan | 61-16829[U] |
| Feb. 10, 1986 | [JP] | Japan | 61-16830[U] |
| Feb. 10, 1986 | [JP] | Japan | 61-16831[U] |
| Jun. 16, 1986 | [JP] | Japan | 61-90565[U] |

[51] Int. Cl.[4] ..... G03D 3/06

[52] U.S. Cl. ..... 354/316; 354/323; 354/324; 354/330

[58] Field of Search ..... 354/307, 310, 311, 312, 354/316, 323, 329, 330, 320, 321, 322, 324

[56] References Cited

U.S. PATENT DOCUMENTS

| | | | |
|---|---|---|---|
| 4,112,452 | 9/1978 | Patton | 354/322 |
| 4,112,453 | 9/1978 | Hutchison | 354/330 |
| 4,112,454 | 9/1978 | Harvey | 354/330 |
| 4,167,320 | 9/1979 | Hutchison | 354/323 |
| 4,178,091 | 12/1979 | Solomon | 354/322 |
| 4,188,106 | 2/1980 | Harvey | 354/330 |
| 4,252,430 | 2/1981 | Michal | 354/322 |
| 4,329,042 | 5/1982 | Libicky | 354/324 |
| 4,456,355 | 6/1984 | Kaufmann et al. | 354/330 |
| 4,502,772 | 3/1985 | Mihara | 354/312 |

*Primary Examiner*—A. A. Mathews

*Attorney, Agent, or Firm*—Larson and Taylor

[57] ABSTRACT

This photosensitive material treating apparatus comprises a conventional treating unit and a disc film treating unit which is attached to the former in the side-by-side relation. The first-mentioned treating unit includes a series of treating baths for carrying out a series of treatments such as developing, bleaching, fixing and others for conventional photosensitive material such as strip of photographic film, printing paper or the like and it is housed in a dark box. The disc film treating unit includes a plurality of tanks into which specific treating liquid is separately introduced from the first-mentioned treating unit for treating several disc films, a hot water bath for heating the tanks in order to maintain a temperature of each of treating liquids at a properly determined level of temperature such as specified temperature for treating the disc films and a single disc film treating tank into which plural treating liquids are successively supplied from the tanks in accordance with a predetermined order to treatments for the disc films.

14 Claims, 9 Drawing Figures

PHOTOSENSITIVE MATERIAL TREATING APPARATUS

BACKGROUND OF THE INVENTION

1. Field of the Invention

The present invention relates to a photosensitive material treating apparatus and more particularly to an apparatus for treating a small number of disc films by utilizing a conventional treating unit that is called an automatic developing apparatus for treating a large number of photosensitive materials such as strip of photographic film, printing paper or the like as well as a part for treating liquids which are used in the aforesaid conventional treating unit. As is well known, the amount of consumption of disc films is still at a lower level, compared with that of strip of photographic films, printing papers or the like.

2. Description of the Prior Art

In recent years, a disc-shaped photographic film called disc film which has an outer diameter dimensioned to about 6.5 cm and which is formed with a fitting hole having an inner diameter of about 1 cm at the central part and has a number of exposure portions for photographing arranged in equally spaced relation in the area located adjacent to the periphery thereof has been developed to be used in place of conventional strips of photographic films which have been used widely.

In connection with the development of disc films as mentioned above there were already a variety of proposals as to treating apparatus, treating machines and associated devices usable for carrying out a series of so-called developing treatments for disc films ranging from developing to stabilizing as disclosed in, for instance, U.S. Pat. Nos. 4,112,452, 4,112,453, 4,112,454 (British Pat. No. 1602492), U.S. Pat. Nos. 4,167,320, 4,178,091 and 4,252,430. However, each of the above-noted prior patents concerning apparatus, machines and devices is made in compliance with the conventional treating process or system for treating a large number of photographic films at a highly increased operational efficiency. Accordingly, employment of the conventional treating process or system is not economically advantageous and has a shortage in practicability due to the current situation that the amount of consumption of disc films is still at a low level.

In view of the, above inventors who work with the same assignee as the inventors of the present applications developed an apparatus for treating disc films as disclosed in U.S. Pat. No. 4,502,772, British Pat. No. 2122771 and German Pat. No. 3317814. This apparatus is so constructed that an improved treating unit for treating disc films is attached to a treating unit for treating conventional photosensitive material such as photographic film, printing paper or the like in order to assure an increased economical effect. However, since the apparatus of the prior invention is based on the hitherto known technical concept that there is a necessity for a dark box which unavoidably has considerable operational inconvenience in the same way as the conventional treating apparatus for treating a large number of photosensitive material (e.g. photographic film, printing paper or the like). Accordingly, from the viewpoint of economy the apparatus has a problem in treating a small number of disc films.

BRIEF SUMMARY OF THE INVENTION

Hence, the present invention has been made with the foregoing background in mind.

A main object of the present invention is to provide a photosensitive material treating apparatus which makes it possible to use a part of a structural component in common and utilize treating liquids in treating liquid baths by attaching a treating unit for treating a small number of disc films to a long treating unit for treating conventional photosensitive material such as strip of photographic film, printing paper or the like, resulting in reduction of space required for installation of the apparatus and increased economical performance of the apparatus being achieved.

Another object of the present invention is to provide a photosensitive material treating apparatus which assures that only a single treating tank for treating a small number of disc films is required into which treating liquids are successively introduced in accordance with a predetermined order but there is no necessity for a long dark box, although a series of developing treatments can be carried out for disc films even in a bright room.

Another object of the present invention is to provide a photosensitive material treating apparatus which includes a cassette for preparing disc films to be treated so that a series of developing treatments can be carried out for disc films even in a bright room.

Further, another object of the present invention is to provide a photosensitive material treating apparatus which is simple in structure, small in size, can be easily operated and has an excellent treating efficiency so as to adapt itself to a requirement for a treating apparatus for treating a small number of small disc films.

To accomplish the above objects there is proposed according to the present invention a photosensitive material treating apparatus comprising a treating unit including a series of treating liquid baths for carrying out a series of developing treatments such as developing, bleaching, fixing and others for photosensitive material such as strip of photographic film, printing paper or the like, the treating unit being housed in a dark box and each of the treating liquid baths being equipped with a treating liquid supply device, a disc film treating unit including a plurality of tanks into which specific treating liquid is separately introduced from the first-mentioned treating unit for treating several number of disc films, a hot water bath for heating the tanks in order to maintain a temperature of each of treating liquids introduced thereinto at a properly determined level of temperature such as a specified temperature for treating the disc films and a single disc film treating tank into which the treating liquids are successively supplied from the tanks in accordance with a predetermined order of treatments for the disc films, and the disc film treating unit being attached to the first-mentioned treating unit in the side-by-side relation.

DESCRIPTION OF THE DRAWINGS

The accompanying drawings schematically illustrate a photosensitive material treating apparatus in accordance with preferred embodiments of the present invention by preparing them to such an extent that they can be easily understood by any expert in the art to which the present invention pertains, although components which could be easily understood by him are not illustrated as far as possible for the purpose of simplification.

FIG. 1 is a schematic side view of the apparatus of which part is not illustrated, of which another part is vertically sectioned and of which another part is cut away to clearly illustrate the structure of various components thereof.

FIG. 2 is a schematic plan view of the apparatus in FIG. 1 of which part is not illustrated, of which another part is transversely sectioned and of which another part is cut away in the same manner in FIG. 1 to clearly illustrate the structure of various components thereof.

FIG. 3 is a side view particularly illustrating the disc film treating unit.

FIG. 4 is a side view of a treating tank in the disc film treating unit, wherein the left half of the tank is vertically sectioned.

FIG. 5 is a vertical sectional view of a disc film preparing cassette to be firmly mounted on the treating tank in FIG. 4.

FIG. 6 is a plan view of the disc film preparing cassette in FIG. 5.

FIG. 7 is an enlarged vertical sectional view of the lower end part of a disc film support shaft in the disc film preparing cassette.

FIG. 8 is a schematic side view of the apparatus similar to FIG. 1, wherein illustration is achieved in the same manner in FIG. 1, and FIG. 9 is a schematic plan view of the apparatus in FIG. 8, wherein illustration is achieved in the same manner as in FIG. 2.

DESCRIPTION OF THE PREFERRED EMBODIMENTS

Now, the present invention will be described in a greater detail hereunder with reference to the accompanying drawings which illustrate a treating apparatus for photosensitive material in accordance with first and second embodiments thereof. The treating apparatus essentially comprises a combination of a treating unit similar to a conventional treating apparatus for photosensitive material (e.g. a strip of photographic film, printing paper or the like), for instance, an automatic developing machine which serves as a film processor manufactured and sold under a tradename of QSS by Noritsu Koki Co., Ltd. (which is closely related to the assignee of the present application) and a disc film treating unit for treating a small number of disc films by utilizing a part of each of the treating liquids supplied to the aforesaid treating unit. It should be noted that a large number of photographic films, printing paper or the like are consumed but demand for the disc films is limited and therefore only a relatively small number of disc films are consumed at present.

First, description will be made below as to a treating apparatus in accordance with the first embodiment of the invention with reference to FIGS. 1 to 7.

Figure 1:
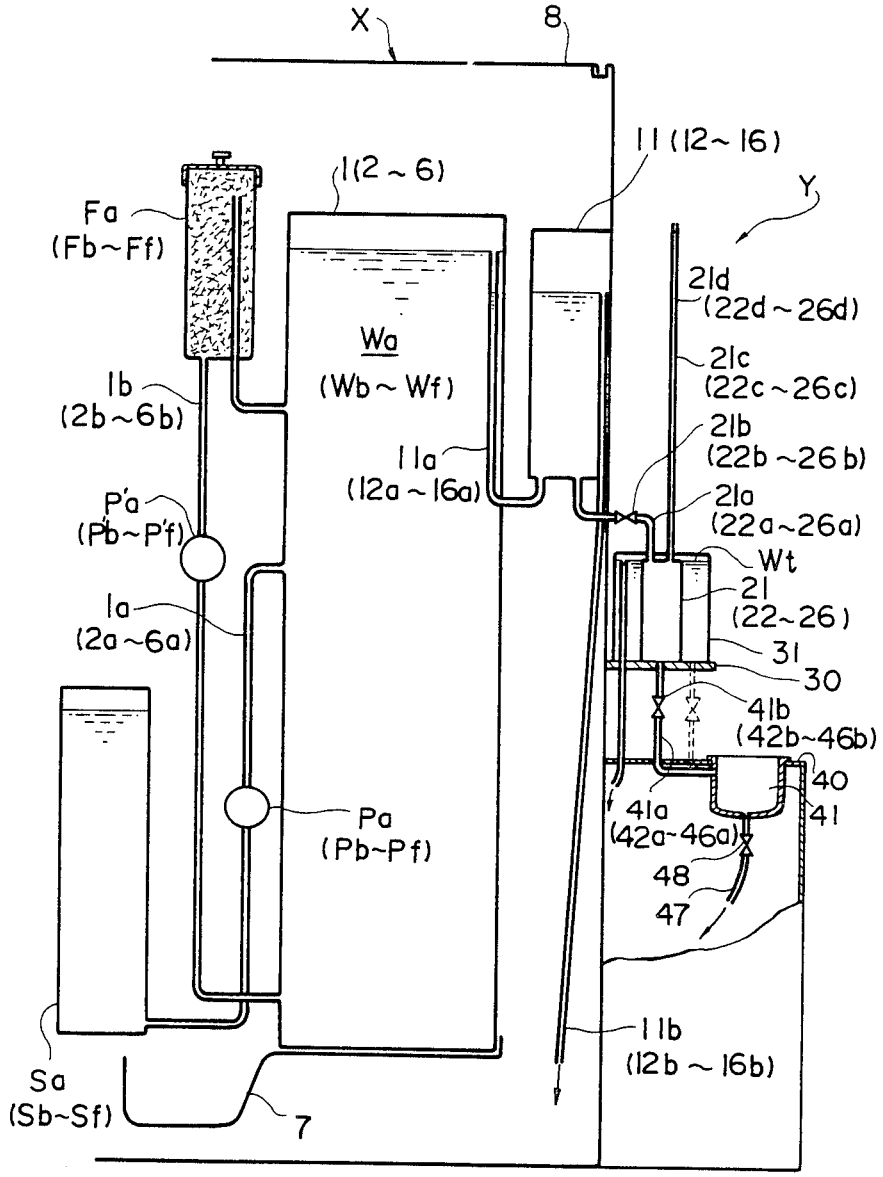
FIGS. 1 to 7 illustrate a photosensitive material treating apparatus in accordance with a first embodiment of the present invention.

Refering to FIG. 1, a section as identified by reference symbol X is a treating unit similar to a conventional automatic developing machine for treating a strip of photographic film, for instance, a film processor manufactured and sold under a tradename of QSS by Noritsu Koki Co., Ltd. and a section as identified by reference symbol Y is a treating unit for treating disc films. The treating apparatus of the invention is constituted by a combination of both the units X and Y and a cassette Z (see FIG. 5) serving also as a magazine to treat disc films F. As will be readily apparent from FIG. 3 of the drawing, the cassette Z is physically related to the unit Y in operation.

Figure 2:
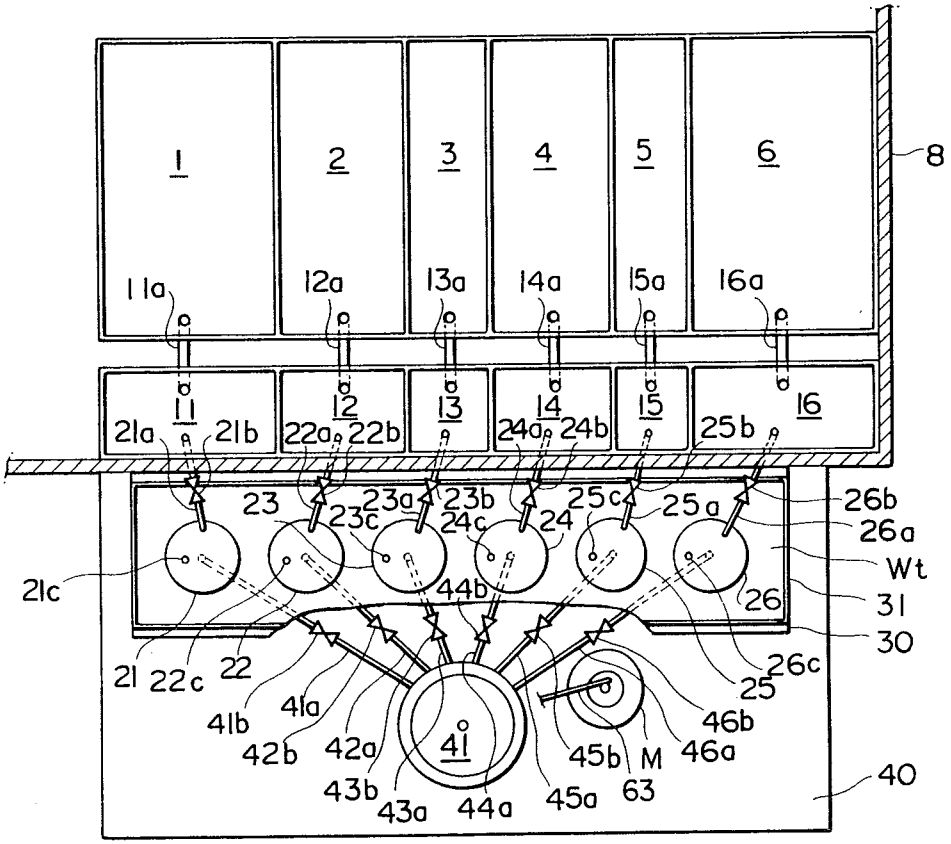

Refering to FIGS. 1 and 2, reference numerals 1, 2, 3, 4, 5 and 6 designate a developing liquid bath, a bleaching liquid bath, a washing water bath, a fixing liquid bath, washing water bath and a stabilizing liquid bath in the unit X. These baths are arranged one after another in the interior of a dark box which is surrounded by an outer panel 8. They include treating liquid supply devices 1*a*, 2*a*, 3*a*, 4*a*, 5*a* and 6*a* which comprise treating liquid storage tanks Sa, Sb, Sc, Sd, Se and Sf and pumps Pa, Pb, Pc, Pd, Pe and Pf. Further, they include treating liquid circulating passages 1*b*, 2*b*, 3*b*, *b*, 5*b* and 6*b* which comprise pumps P'a, P'b, P'c, P'd, P'e and P'f and filters Fa, Fb, Fc, Fd, Fe and Ff. In addition, each of the treating baths is equipped with a thermostat for measuring treating liquid temperature, a heater for heating treating liquid incorporated in a protective tube and a water supply tube for cooling treating liquid each of which is not shown in the drawing for purpose of simplification of illustration. Incidentally, reference numeral 7 designates a waste liquid tank and reference symbols Wa, Wb, Wc, Wd, We and Wf denote treating liquids. If the apparatus of the invention employs a waterless washing system which has been developed in the recent years and exhibits a tendency of increased usage, it is obvious that the above-mentioned components relative to water washing are not required.

Further, the unit Y for treating disc films F includes as main components first tanks 11, 12, 13, 14, 15 and 16 which are designed in an appreciably large size for storing treating liquid overflown from the treating liquid baths 1, 2, 3, 4, 5 and 6 via overflow pipes 11*a*, 12*a*, 13*a*, 14*a*, 15*a* and 16*a*, the first tanks having overflow pipes 11*b*, 12*b*, 13*b*, 14*b*, 15*b* and 16*b* for flowing away excess amount of treating liquid, second tanks 21, 22, 23, 24, 25 and 26 (which may be called metering tanks) which are communicated with the first tanks 11, 12, 13, 14, 15 and 16 via liquid introduction pipes 21*a*, 22*a*, 23*a*, 24*a*, 25*a* and 26*a* with valves 21*b*, 22*b*, 23*b*, 24*b*, 25*b* and 26*b* and include elongated air vent pipes 21*c*, 22*c*, 23*c*, 24*c*, 25*c* and 26*c* with liquid level detectors 21*d*, 22*d*, 23*d*, 24*d*, 25*d* and 26*d* attached thereto, a hot water bath 31 which are mounted on a platform 30 to maintain a temperature of treating liquids introduced into the second tanks 21, 22, 23, 24, 25 and 26 at a specified level of temperature suitable for treating disc film and includes an overflow pipe as well as a hot water supply device, a thermostat for measuring treating liquid temperature and a heater for heating hot water incorporated in a protective tube both of which are not shown in the drawing, and a disc film treating tank 41 mounted on a platform 40 to be communicated with the second tanks 21, 22, 23, 24, 25 and 26 via treating liquid supply pipes 41*a*, 42*a*, 43*a*, 44*a*, 45*a* and 46*a* with valves 41*b*, 42*b*, 43*b*, 44*b*, 45*b* and 46*b* so that treating liquids stored in the second tanks 21, 22, 23, 24, 25 and 26 can be successively delivered thereto only by a volume required for treating several number of disc films F, the disc film treating tank 41 having on the bottom a drain pipe 47 with a valve 48.

The valves 21*b*, 22*b*, 23*b*, 24*b*, 25*b* and 26*b* are so designed that they are opened while the valves 41*b*, 42*b*, 43*b*, 44*b*, 45*b* and 46*b* are closed, they are closed while the valves 41*b*, 42*b*, 43*b*, 44*b*, 45*b* and 46*b* are opened or liquid level is detected by the liquid level detectors 21*d*, 22*d*, 23*d*, 24*d*, 25*d* and 26*d*. The valves 41*b*, 42*b*, 43*b*, 44*b*, 45*b* and 46*b* are so designed that they closed while the valve 48 is opened. All valves may be opened and closed manually.

Figure 3:
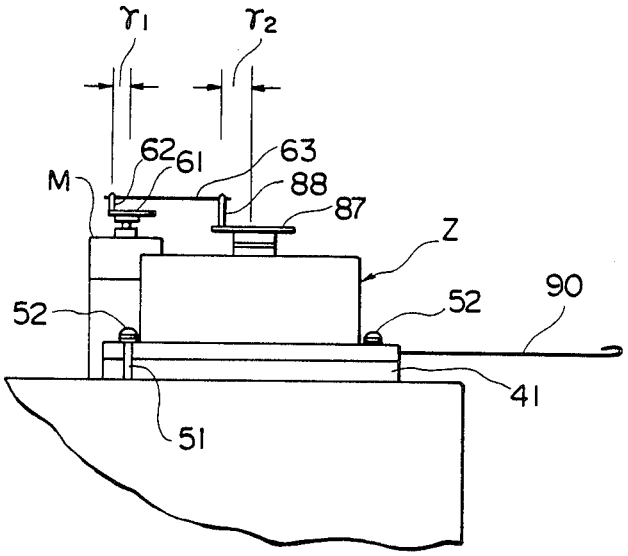
Figure 4:
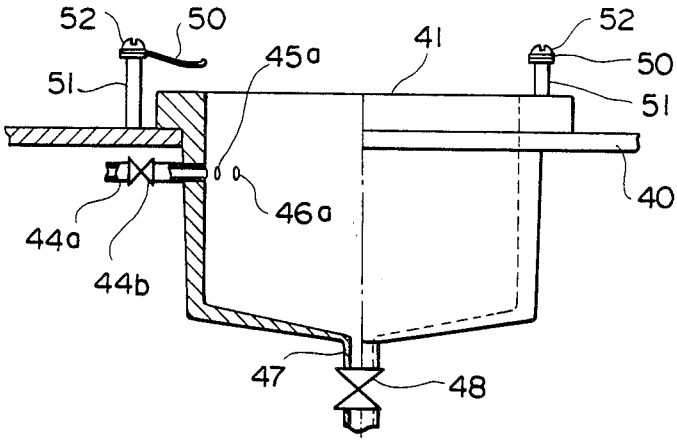

Incidentally, reference symbol M designates a motor for reciprocably rotating a disc film support shaft in the disc film treating cassette Z which will be described in more detail later. Reference numeral 50 designates a cassette retaining spring which is supported on the top of a support shaft 51 to turn about the shaft 51 with the aid of a screw 52 as shown in FIG. 4. As is apparent from the drawing, the support shaft 51 stands upright on the platform 40. As shown in FIG. 3, a circular disc 61 fixedly mounted on the top of the rotational shaft of the motor M has a support shaft 62 located away from an axis thereof by a distance $r_1$.

Figure 5:
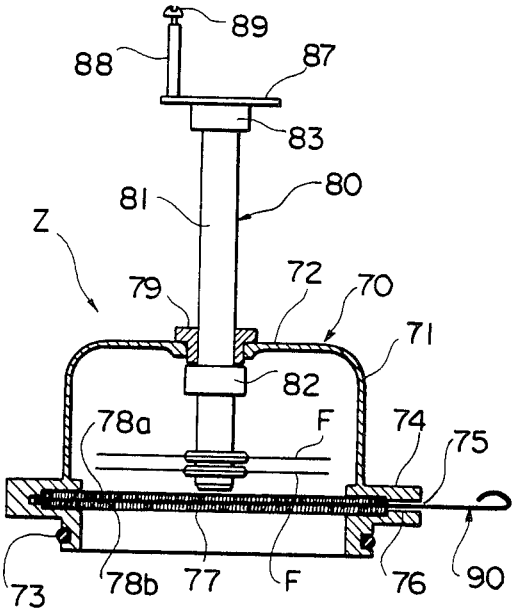
Figure 6:
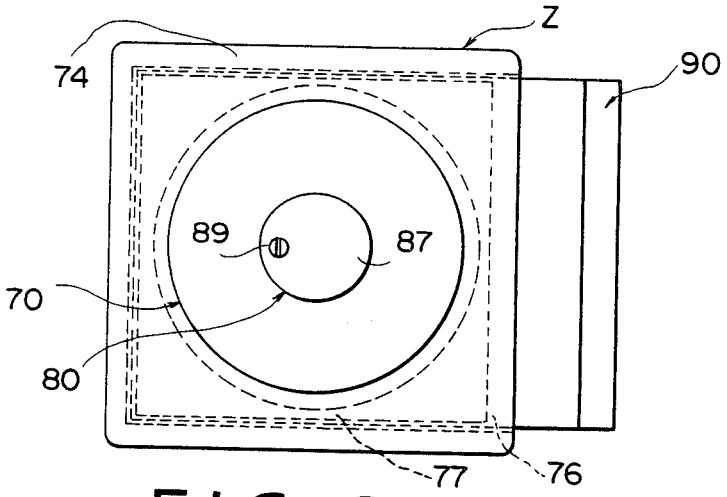
Figure 7:
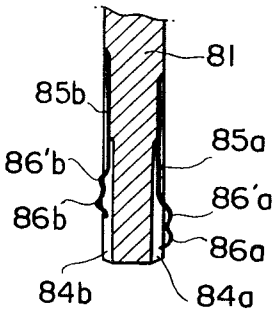

As shown in FIGS. 5 to 7, the cassette Z serving also as a magazine for disc films F is essentially constituted by a housing 70, a support shaft 80 and a light shielding plate 90.

The cassette housing 70 comprises a tubular portion 71 in which several number of disc films F can be accommodated and a top wall 72 with a hole formed at the center part thereof to build an inverted cup-shaped configuration. Further, the housing 70 is formed with a packing groove 73 on the circumferential surface at the lower end part of the tubular portion 71 which is fitted into the disc film treating tank 41 and moreover it is provided with a substantially square engagement flange 74 at the position located slightly above the packing groove 73. An opening 75 is formed on the one side wall of the flange 74 and includes a slit 76 through which a light shielding plate 90 having a width larger than the inner diameter of the tubular portion 71 is inserted. As will be best seen in FIG. 5, the slit 76 has a enlarged portion 77 of which vertical dimension is determined larger than the width of the slit 76 and plushes 78*a* and 78*b* acting as light shielding member are fitted into the space as defined between both the upper and lower surfaces of the enlarged portion 77. The through hole provided at the central area of the top wall 72 is fitted with a bushing 79 (which may be replaced with a bearing) serving as a holding member for rotatably supporting the disc film support shaft 80 in a lighttight manner.

The disc film supporting shaft 80 includes as a main body a shank 81 of a diameter so dimensioned that it is inserted through a fitting hole of a disc film F and which is slidably supported through the hole of the bushing 79. Further, it includes a larger diameter stopper 82 which is positioned so that the lower end of the shank 81 is located slightly above the light shielding member 90 when it is displaced upwardly as shown in FIG. 5 and another larger diameter stopper 83 which is positioned so that several disc films F carried by the lower end part of the support shaft 80 is immersed in treating liquid in the disc film treating tank 41 when it is displaced downwardly. Further, it is formed with a plurality of axially extending grooves 84*a* and 84*b* at the lower end part thereof in which a plurality of leaf springs 85*a* and 85*b* of which upper parts an inserted and fixedly secured to the grooves 84*a* and 84*b*, as shown in FIG. 7. To assure that the disc films F are fixedly fitted on the support shaft 80 in such a closely spaced relation as shown in FIG. 5, the leaf springs 85*a* and 85*b* are formed with a plurality of projections 86*a*, 86*a'*, 86*b* and 86*b'*, as will be best seen in FIG. 7. Moreover, it includes a circular disc 87 fixedly mounted on the stopper 83 and a support shaft 88 stands upright on the circular disc 87, as shown in FIG. 3. The support shaft 88 is located at a position away from the axis of the support shaft 80 by a distance of $r_2$ which is determined larger than $r_1$ for the support shaft 62 (see FIG. 3). The reciprocable movement transmission rod 63 is pivotally fitted onto the support shaft 88 with the aid of a screw 89 to bridge between both the support shafts 62 and 88 in order that rotation of the motor M is transmitted to the shaft 80 via the rod 63 to produce reciprocal movement, since the distance $r_2$ is larger than the distance $r_1$.

Since the apparatus in accordance with the first embodiment of the invention is constructed in the above-described manner, a variety of treatments which have been carried out for conventional photosensitive material such as a strip of photographic film are achieved in the treating unit X in the same manner as the conventional apparatus. Treating liquids Wa, Wb, Wc, Wd, We and Wf overflown from the treating baths 1, 2, 3, 4, 5 and 6 during treating operations are stored in the first tanks 11, 12, 13, 14, 15 and 16 via the overflow pipes 11*a*, 12*a*, 13*a*, 14*a*, 15*a* and 16*a*. Incidentally, an excessive volume of overflown treating liquids Wa, Wb, Wc, Wd, We and Wf are discharged into the waste liquid tank 7 via overflow pipes 11*b*, 12*b*, 13*b*, 14*b*, 15*b* and 16*b*.

When disc films F are subjected to certain treating, the light shielding plate 90 which closes the opening at the lower end of the tubular portion 71 constituting the housing 70 of the cassette Z and inhibits the support shaft 80 from being depressed is pulled in the sideward direction. Now, the support shaft 80 is ready to be depressed by an operator. Then, it is depressed until the stopper 83 abuts against the bushing 79 and its lower end part is fitted through the fitting holes on the disc films F which have latent images against resilient force of the leaf springs 85*a* and 85*b* in a dark room. Thus, the disc films F are firmly held on the support shaft 80 with the aid of the projections 86*a*, 86*a'*, 86*b* and 86*b'* on the leaf springs 85*a* and 85*b* in such a state that they are inhibited from any rotation and displacement. Thereafter, as shown in FIG. 5, they are raised up until the stopper 82 abuts against the bushing 79 and the light shielding plate 90 is then inserted into the interior of the housing 70 again until the latter is completely shielded so as to inhibit any entrance of a light beam into the interior thereof.

After several exposed disc films F are accomodated in the cassette Z in that way, the lower end part of the housing 70 of the cassette Z is fitted into the treating tank 41 and the square engagement flange 74 is placed on the same. Then, the cassette Z is firmly held on the treating tank 41 under the effect of resilient force of the leaf springs 50 and thereafter the light shielding plate 90 is pulled outwardly to the position where there does not occur any inhibition of the support shaft 80 from being depressed. Next, the support shaft 80 is depressed until the stopper 83 abuts against the bushing 79 and the end of the reciprocal movement transmission rod 63 is pivotally fitted onto the support shaft 88 with the aid of the retaining screw 89. Now, the disc films F are ready to be subjected to certain treating.

Next, by depressing operation buttons which are not shown in the drawings, the valves 41*b*, 42*b*, 43*b*, 44*b*, 45*b* and 46*b* in the treating liquid supply pipes 41*a*, 42*a*, 43*a*, 44*a*, 45*a* and 46*a* are closed and the valves 21*b*, 22*b*, 23*b*, 24*b*, 25*b* and 26*b* in the treating liquid introduction pipes 21*a*, 22*a*, 23*a*, 24*a*, 25*a* and 26*a* are opened whereby treating liquids Wa, Wb, Wc, Wd, We and Wf in the first tanks 11, 12, 13, 14, 15 and 16 are introduced into the second tanks 21, 22, 23, 24, 25 and 26. When the liquid level detectors 21*d*, 22*d*, 23*d*, 24*d*, 25*d* and 26*d* on the air vent pipes 21*c*, 22*c*, 23*c*, 24*c*, 25*c* and 26*c* detect liquid level of treating liquids Wa, Wb, Wc, Wd, We and Wf, the valves 21*b*, 22*b*, 23*b*, 24*b*, 25*b* and 26*b* are closed in response to detection signal transmitted from the detectors 21*d*, 22*d*, 23*d*, 24*d*, 25*d* and 26*d*. On the other hand, the treating liquids Wa, Wb, Wc, Wd, We and Wf are heated by hot water Wt in the hot water bath 31 to keep them at a level of temperature most suitable for treating the disc films F.

Then, each of the treating liquids Wa, Wb, Wc, Wd, We and Wf in the second tanks 21, 22, 23, 24, 25 and 26 heated up to the optimum level of temperature suitable for treating disc films F is supplied to the single disc film treating tank 41 by successively opening the valves 41*b*, 42*b*, 43*b*, 44*b*, 45*b* and 46*b* in accordance with a predetermined order so that they are subjected to certain treating. After completion of the latter the valve 48 is opened and thereby treating liquid used therefor is drained from the treating tank 41.

After the valves 41*b*, 42*b*, 43*b*, 44*b*, 45*b* and 46*b* are closed, the valves 21*b*, 22*b*, 23*b*, 24*b*, 25*b* and 26*b* are opened and thereby treating liquids Wa, Wb, Wc, Wd, We and Wf stored in the first tanks 11, 12, 13, 14, 15 and 16 are introduced into the second tanks 21, 22, 23, 24, 25 and 26 from which treating liquids will be supplied to the treating tank 41 later. Now, the next treating for disc films F is ready to be initiated.

In the illustrated embodiment each of the above-mentioned treatments is carried out in accordance with the conventional automatic treating system which has been employed for this kind of treatment. However, the present invention should not be limited only to this. Alternatively, they may be carried out manually.

Incidentally, in the case where the treating unit X is constructed in accordance with the specification of waterless washing for treating strip of photographic films etc. but water washing is required for treating disc film F or in the case where the first tanks 13 and 15 and the second tanks 23 and 25 in which treating liquids Wc and We coming from the washing water baths 3 and 5 are stored are eliminated, treating liquid supply pipes 43*a* and 45*a* with valves 43*b* and 45*b* fitted thereto may be communicated with the hot water bath 31 so as to permit hot water Wt in the hot water bath 31 to be used for the purpose of water washing, as represented by chain line in FIG. 1. If the treating liquid introduction pipes 21*a*, 22*a*, 23*a*, 24*a*, 25*a* and 26*a* and the air vent pipes 21*c*, 22*c*, 23*c*, 24*c*, 25*c* and 26*c* are designed to have a reduced inner diameter, the valves 21*b*, 22*b*, 23*b*, 24*b*, 25*b* and 26*b* and the liquid level detectors 21*d*, 22*d*, 23*d*, 24*d*, 25*d* and 26*d* may be eliminated.

As will be readily apparent from the above description, a conventionally-designed single treating apparatus is not employed but treating liquid overflowed from each of the treating baths which has been hitherto wasted is effectively utilized in such a manner that only a volume of treating liquid required for certain treating is taken from one of tanks in which overflowed liquid is stored. The treating-liquid to a temperature suitable for treating disc films and it is then delivered to a single disc treating tank 41 in accordance with a predetermined order of steps of treating disc films so that the latter are treated as required. Owing to the construction of the apparatus of the invention it is possible to treat disc films easily even when the number of disc films to be treated is small. Other advantageous features of the invention are that the apparatus is simple in structure and has economical performance.

Next, description will be made below as to a second embodiment of the invention.

Figure 9:
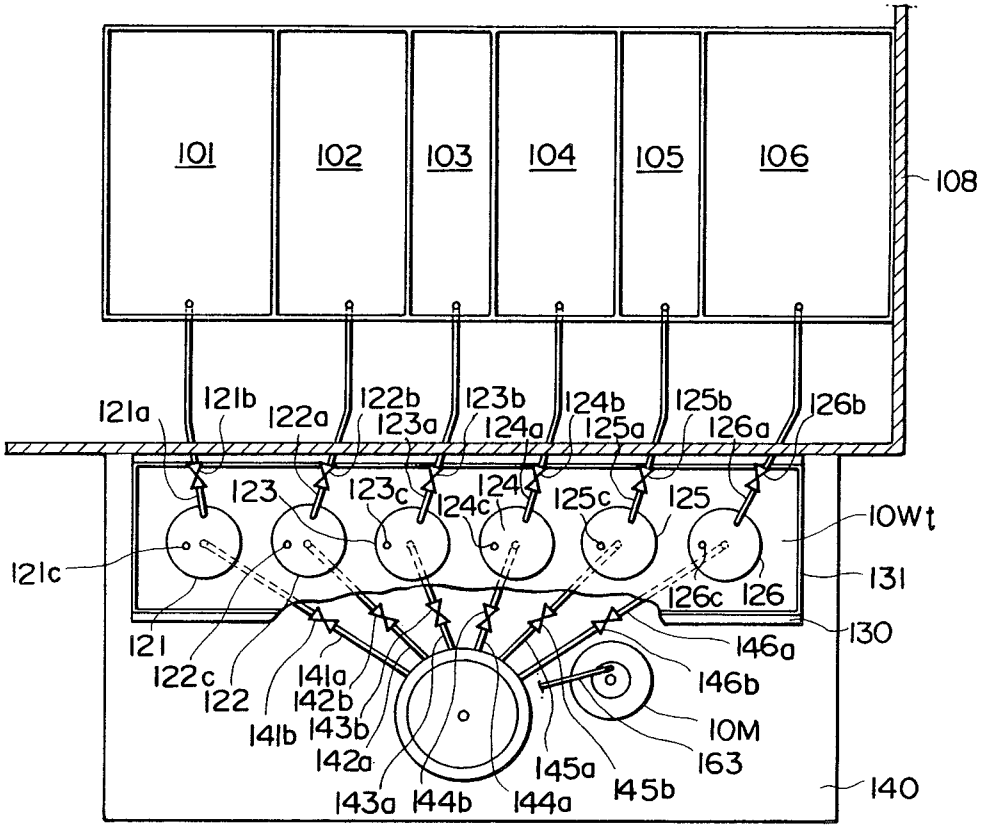
FIGS. 8 and 9 illustrate a photosensitive material treating apparatus in accordance with a second embodiment of the present invention, wherein substantially the same components as those in the first embodiment are not shown for the purpose of simplification.
Figure 8:
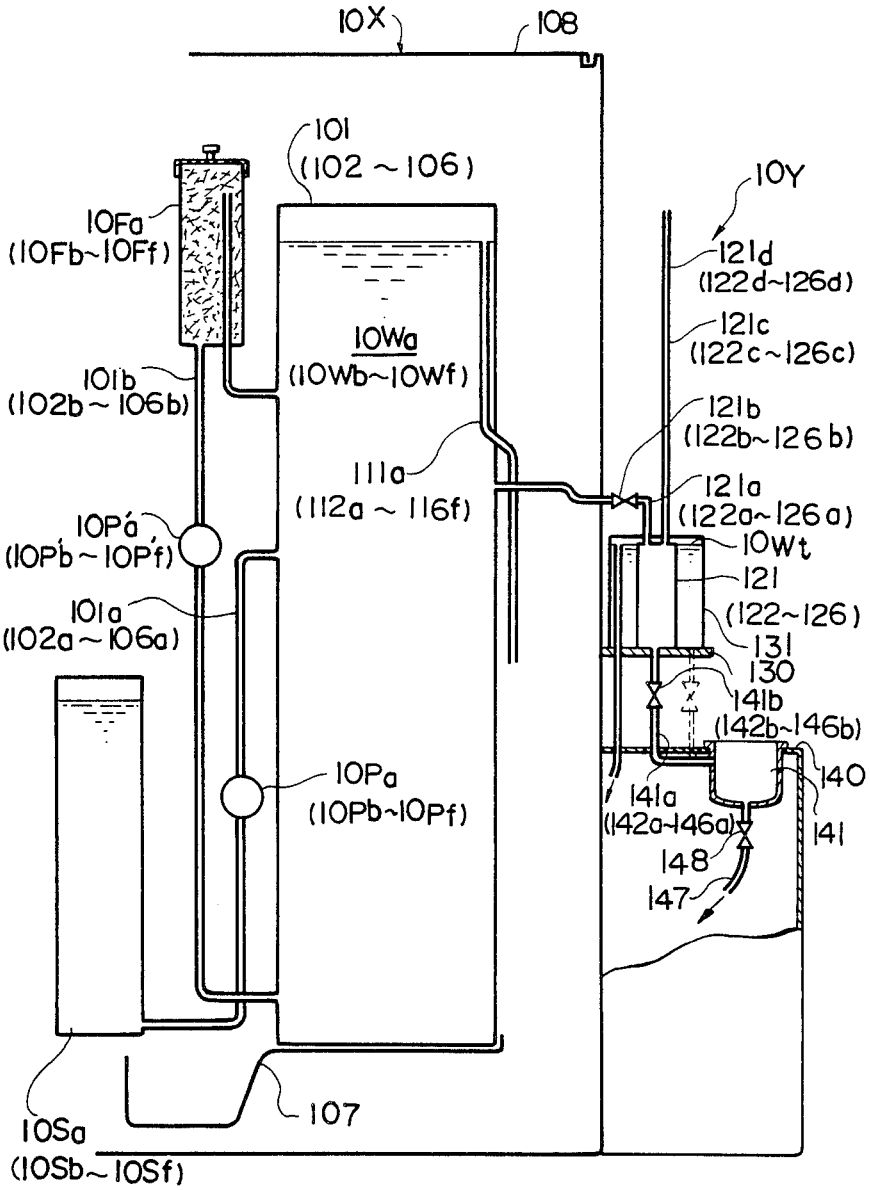

As will be apparent from comparisons between FIG. 1 and FIG. 8 as well as between FIG. 2 and FIG. 9, the second embodiment is different slightly from the first embodiment in respect of the facts that the first tanks 11, 12, 13, 14, 15 and 16 in the first embodiment are eliminated, the treating liquid introduction pipes 21*a*, 22*a*, 23*a*, 24*a*, 25*a*, and 26*a* in the first embodiment are employed as treating liquid introduction pipes 121*a*, 122*a*, 123*a*, 124*a*, 125*a* and 126*a*, the foremost ends of the latter are opened at the walls of the same treating liquid baths 101, 102, 103, 104, 105 and 106 as the treating liquid baths 1, 2, 3, 4, 5 and 6 in the foregoing embodiment, and treating liquids 10Wa, 10Wb, 10Wc, 10Wd, 10We and 10Wf (which are same as treating liquids Wa, Wb, Wc, Wd, We and Wf in the foregoing embodiment) overflowed from the treating liquid baths 101, 102, 103, 104, 105 and 106 are not used but a part of each of the treating liquids 10Wa, 10Wb, 10Wc, 10Wd, 10We and 10Wf stored in the treating liquid baths 101, 102, 103, 104, 105 and 106 is used in the treating unit 10Y in which disc films F are treated. Further, since the same cassette Z as in the first embodiment is used for the second embodiment, repeated description will not be required with respect to the second embodiment but description will be made below only as to how components for the second embodiment correspond to those in the first embodiment.

Specifically, a treating unit as identified by reference numeral 10X corresponds to the treating unit X in the first embodiment. An outer panel as identified by reference numeral 108 corresponds to the outer panel 8; treating liquid baths as identified by reference numerals 101, 102, 103, 104, 105 and 106 corresponds to the treating liquid baths 1, 2, 3, 4, 5 and 6, treating liquid supply devices as identified by reference numerals 101*a*, 102*a*, 103*a*, 104*a*, 105*a* and 106*a* correspond to the treating liquid supply devices 1*a*, 2*a*, 3*a*, 4*a*, 5*a* and 6*a*; treating liquid storage tanks as identified by reference numerals 10Sa, 10Sb, 10Sc, 10Sd, 10Se and 10Sf correspond to the treating liquid storage tanks Sa, Sb, Sc, Sd, Se and Sf; pumps 10Pa, 10Pb, 10Pc, 10Pd, 10Pe and 10Pf correspond to the pumps Pa, Pb, Pc, Pd, Pe and Pf; pumps 10P'a, 10P'b, 10P'c, 10P'd, 10P'e and 10P'f correspond to the pumps P'a, P'b, P'c, P'd, P'e and P'f; filters as identified by reference numerals 10Fa, 10Fb, 10Fc, 10Fd, 10Fe and 10Ff, correspond to the filters Fa, Fb, Fc, Fd, Fe and Ff; treating liquid circulating passages as identified by reference numerals 101*b*, 102*b*, 103*b*, 104*b*, 105*b* and 106*b* correspond to the treating liquid circulating passages 1b, 2*b*, 3*b*, 4*b*, 5*b* and 6*b*; treating liquids as identified by reference numerals 10Wa, 10Wb, 10Wc, 10Wd, 10We and 10Wf correspond to the treating liquids Wa, Wb, Wc, Wd, We and Wf; a treating unit as identified by reference numeral 10Y correspond to the treating unit Y; tanks as identified by reference numerals 121, 122, 123, 124, 125 and 126 correspond to the second tanks 21, 22, 23, 24, 25 and 26; valves as identified by reference numerals 121*b*, 122*b*, 123*b*, 124*b*, 125*b* and 126*b* correspond to the valves 21*b*, 22*b*, 23*b*, 24*b*, 25*b* and 26*b*; air vent pipes as identified by reference numerals 121*c*, 122*c*, 123*c*, 124*c*, 125*c* and 126*c* correspond to the air vent pipes 21*c*, 22*c*, 23*c*, 24*c*, 25*c* and 26*c*; liquid level detectors as identified by reference numerals 121*d*, 122*d*, 123*d*, 124*d*, 125*d* and 126*d* correspond to the liquid level detectors 21*d*, 22*d*, 23*d*, 24*d*, 25*d* and 26*d*; a platform as identified by reference numeral 130 correspond to the platform 30; a hot water bath as identified by reference numeral 131 correspond to the hot water bath 31; hot water as identified by reference numeral 10Wt correspond to the hot water Wt; a platform as identified by reference numeral 140 correspond to the platform 40; a disc film treating tank as identified by reference numeral 141 corresponds to the disc film treating tank 41; treating liquid supply pipes as identified by reference numerals 141*a*, 142*a*, 143*a*, 144*a*, 145*a* and 146*a* corresponds to the treating liquid supply pipes 41*a*, 42*a*, 43*a*, 44*a*, 45*a* and 46*a*; valves as identified by reference numerals 141*b*, 142*b*, 143*b*, 144*b*, 145*b* and 146*b* corresponds to the valves 41*b*, 42*b*, 43*b*, 44*b*, 45*b* and 46*b*, a drain pipe as identified by reference numeral 147 with a valve 148 fitted thereto corresponds to the drain pipe 47 with the valve 48 fitted there, a motor as identified by reference numeral 10M corresponds to the motor M and a reciprocable movement transmission rod as identified by reference numeral 163 corresponds to the reciprocable movement transmission rod 63. It should be added that the above-mentioned components in the second embodiment function and are operated in the substantially same manner as those in the first embodiment.

Incidentally, the second embodiment uses the same cassette Z as in the first embodiment. Though the illustration is eliminated for the purpose of simplification, a manner of immovably mounting the cassette on the disc film treating tank 141 and a mechanism for transmitting reciprocable rotational movement to the disc film support shaft in the thus mounted cassette are the same as those in the first embodiment.

It can be easily understood by any expert in the art that the second embodiment exhibits substantially the same functional effects as those in the first embodiment.

While the present invention has been described above with respect to two preferred embodiments thereof, it should of course be understood that it should not be limited only to them but various changes or modifications may be made in any acceptable manner without departure from the spirit and scope of the invention as defined by the appended claims.

What is claimed is:

1. A photosensitive material treating apparatus comprising;

a treating unit including a series of treating liquid baths for carrying out a series of developing treatments such as developing, bleaching, fixing and others for photosensitive material such as strip of photographic film, printing paper or the like, said treating unit being housed in a dark box and each of said treating liquid baths being equipped with a treating liquid supply device, a disc film treating unit including a plurality of tanks into which specific treating liquid separately introduced from the first-mentioned treating unit for treating several number of disc films is stored, a hot water bath for heating said tanks in order to maintain a temperature of each of treating liquids at temperature suitable for treating said disc films and a single disc film treating tank into which said treating liquids are successively supplied from said tanks in accordance with a predetermined order of treatments for the disc films, and said disc film treating unit being attached to the first-mentioned treating unit in the side-by-side relation.

2. A photosensitive material treating apparatus as defined in claim 1, wherein each of the treating liquids to be used for treating several disc films is treating liquid which is overflown from each of the treating liquid baths in the first-mentioned treating unit in which a series of developing treatments such as developing, bleaching, fixing and others are carried out for photosensitive material such as strip of photographic film, printing paper or the like.

3. A photosensitive material treating apparatus as defined in claim 1, wherein each of the treating liquids to be used for treating several disc films is a part of treating liquid extracted from each of the treating liquid baths in which treating liquids are stored for treating photosensitive material in the first-mentioned treating unit in which a series of developing treatments such as developing, bleaching, fixing and others are carried out for the photosensitive material such as strip of photographic film, printing paper or the like.

4. A photosensitive material treating apparatus as defined in claim 1, wherein the plural tanks in which treating liquids to be used for treating several disc films are separately stored are equipped with a liquid level detector respectively.

5. A photosensitive material treating apparatus as defined in claim 1 or 4, wherein the plural treating liquid baths and the plural treating liquid tanks in which treating liquids to be used for treating several disc films are separately stored are separately connected to one another via treating liquid introduction pipes with a valve fitted thereto respectively and wherein the valves fitted to said treating liquid introduction pipes are closed when the liquid level detectors on the treating liquid tanks detect liquid level but they are opened until they detect it.

6. A photosensitive material treating apparatus as defined in claim 1 or 4, wherein the plural tanks in which treating liquids to be used for treating several disc films are separately stored and a single disc film treating tank are separately connected to one another via treating liquid supply pipes with a valve fitted thereto respectively and wherein the valves can be opened when the liquid level detectors on the tanks detect liquid level but they can not be opened until they detect it.

7. A photosensitive material treating apparatus comprising;

a treating unit including a series of treating liquid baths for carrying out a series of developing treatments such as developing, bleaching, fixing and others for photosensitive material such as strip of photographic film, printing paper or the like, said treating unit being housed in a dark box and each of said treating liquid baths being equipped with a treating liquid supply device, a disc film treating unit including a plurality of first tanks in which treating liquids overflown from the treating liquid baths are separately stored, a plurality of second tanks into which specific treating liquid introduced from each of said first tanks by a volume required for treating several disc films is stored, a hot water bath for heating said second tanks in order to maintain a temperature of each of treating liquids at temperature suitable for treating said disc films and a single disc film treating tank into which said treating liquids are successively supplied from said second tanks in accordance with a predetermined order of treatments for the disc films, and said disc film treating unit being attached to the first-mentioned treating unit in the side-by-side relation.

8. A photosensitive material treating apparatus as defined in claim 7, wherein the first tanks are provided with an overflow pipe respectively.

9. A photosensitive material treating apparatus as defined in claim 7, wherein the second tanks in which treating liquids to be used for treating several disc films are separately stored are equipped with a liquid level detector respectively.

10. A photosensitive material treating apparatus as defined in claim 7 or 9, wherein the first tanks and the second tanks are separately connected to one another via treating liquid introduction pipes with a valve fitted thereto respectively and wherein the valves fitted to said treating liquid introduction pipes are closed when the liquid level detectors on the second tanks detect liquid level but they are opened until they detect it.

11. A photosensitive material treating apparatus as defined in claim 7 or 9, wherein the second tanks and the single disc film treating tank are separately connected via treating liquid supply pipes with a valve fitted thereto respectively and wherein the valves fitted to said treating liquid supply pipes can be opened when the liquid level detectors on the second tanks detect liquid level but they can not be opened until they detect it.

12. A photosensitive material treating apparatus as defined in claim 1 or 7, wherein the single disc film treating tank includes on the bottom a drain pipe with a valve fitted thereto.

13. A photosensitive material treating apparatus as defined in claim 1 or 7, wherein a cassette for preparing disc films to be treated is immovably mounted on the single disc film treating tank, said cassette comprising a housing, disc film support shaft and a light shielding plate, said housing being constituted by a tubular portion in which disc films to be treated can be accommodated and a top wall with a holding member attached thereto in an inverted cup-shaped configuration, said holding member serving to lighttightly hold said disc film supporting shaft so as to allow the latter to slidably move up and down therethrough, said tubular portion including a fitting part for mounting the cassette on the disc film treating tank and a light shield plate insert slit at the lower end part thereof through which a light shield plate is inserted and pulled outwardly, said disc film supporting shaft including a disc film support part at the lower end and a rotational driving part at the upper end thereof.

14. A photosensitive material treating apparatus as defined in claim 13, wherein the disc film support shaft extending through the cassette to be immovably mounted on the single disc film treating tank is reciprocably rotated by means of a driving member.

* * * * *